US005184486A

United States Patent [19]

Murai et al.

[11] Patent Number: 5,184,486

[45] Date of Patent: Feb. 9, 1993

[54] APPARATUS FOR TREATING CLOTH IN FLOWING LIQUID

[75] Inventors: Naobumi Murai, Fukui; Tadashi Kurokawa, Osaka, both of Japan

[73] Assignee: Tomen America Inc., New York, N.Y.

[21] Appl. No.: 812,664

[22] Filed: Dec. 23, 1991

[51] Int. Cl.[5] ..... D06B 3/24

[52] U.S. Cl. ..... 68/175

[58] Field of Search ..... 68/175, 176, 177, 178, 68/179

[56] References Cited

U.S. PATENT DOCUMENTS 3,982,411 9/1976 Kreitz ..... 68/177

FOREIGN PATENT DOCUMENTS 3190063 8/1988 Japan ..... 68/177

113508 3/1945 Sweden ..... 68/175

*Primary Examiner*—Philip R. Coe

*Attorney, Agent, or Firm*—Edwin E. Greigg; Ronald E. Greigg

[57] ABSTRACT

In an apparatus for treating a cloth in a flowing liquid comprising a pool having a bottom curved in a shape of U-letter, a conveying passage continued to the pool, a pull-up reel arranged above the pool, wherein a cloth is circulated with the flowing liquid. The apparatus is characterized by that the bottom of the pool is constructed to have a concave surface forming a shape of U-letter in section. The apparatus may further provide ring-like driving nozzle means as well as regularizing nozzle means for injecting a treating liquid downwardly along the inner periphery.

2 Claims, 14 Drawing Sheets

APPARATUS FOR TREATING CLOTH IN FLOWING LIQUID

BACKGROUND OF THE INVENTION (1) Field of the Invention

The present invention relates to an apparatus for treating a cloth in a flowing liquid which is capable of efficiently producing a treated material of high quality such as a dyed cloth. According to such an apparatus, when giving a flowing liquid treatment to a cloth which is set in endless, the surfaces of the cloth are reversed according to its circulation so that so called "raw folding" and "Sure in Japanese" may be controlled to a minimum. The flowing liquid treatment in this invention is for such as dyeing, washing, scouring or relaxing the cloth. "Sure in Japanese" as used in this disclosure means a friction mark on the cloth. A friction mark will appear on a silk or rayon cloth due to friction and it affects the luster of the cloth.

(2) Description of the Prior Art

For instance, as shown in FIG. 10, in a conventional apparatus for treating a cloth in a flowing liquid, an endless cloth a was set on a pool b, a conveying passage c and a pull-up reel d, and the cloth a was circulated with a flowing liquid so that a flowing liquid treatment was given to the cloth a. In the apparatus, a contact surface f of the cloth a with a periphery e of the reel d was always the same side with respect to the periphery e.

Therefore, when the apparatus gave a flowing liquid treatment to the cloth, the cloth surface f contacting the periphery e of the pull-up reel d, was damaged easily to have so called "raw folding" and "Sure in Japanese".

As the result, wrinkles of the cloth due to "raw folding" were fixed or uneveness of gloss of the cloth due to "Sure in Japanese" was occurred so that the quality of the product was lowered.

Recently, it was conventional to carry out a flowing liquid treatment with a low immerging ratio in viewpoint of saving an energy or increasing productivity. In the flowing liquid treatment with such a low immerging ratio, when the cloth was moved in the pool, it was difficult that the contact surface f with the periphery e of the pull-up reel d contacted with the liquid evenly.

Therefore, there was a problem that good effects of flowing liquid treatment such as levelling or exhausion in dyeing and also a washing effect with a water could not be obtained.

The inventor of this invention proposed Japanese patent publication Hei. 3-29906, which related to an apparatus for treating a cloth in a flowing liquid, in order to solve the above mentioned problems.

The apparatus will be described with reference to FIG. 11. The apparatus comprises a pool h, a conveying passage i and a pull-up reel j. The pool has a bottom g which is curved in a shape of U-letter to present a spiral around a vertical axis, and the bottom g is formed to be gradually lowered from an upper end to a lower end and flat. The conveying passage is formed to connect a lower end thereof to the upper end of the pool h. The pull-up reel is arranged at an upper position above the lower end of the pool h. A cloth k is set on the pool h, the conveying passage i and the pull-up reel j endlessly so as to be circulated with a flowing liquid. The apparatus has the following functions.

Namely, as shown in FIG. 11, the endless cloth k is set on the pull-up reel j, the conveying passage i and the pool h in such a state that the cloth is twisted once like a Mobius band. As the result, the cloth is conveyed with a flowing liquid on the conveying passage i in a state of non-twist and discharged in the pool h at the lower end of the conveying passage i. Thus, the discharged cloth k is conveyed in the pool h (In FIG. 11, the state of movement of the cloth in the pool is shown with phantom lines.) and thereafter the cloth is pulled up by means of the pull-up reel j and then conveyed again in the conveying passage i.

The cloth k is, thus, circulated in the apparatus. Since the bottom g of the pool h is curved in the shape of U-letter to present a spiral around a vertical axis, the cloth k moving on the curved bottom g moves in such a state that the contact surface n contacting the periphery m of the pull-up reel j faces the bottom g. Therefore, the contact surface n of the cloth contacting the periphery m can be turned upside down smoothly and easily while the endless cloth circulates in a cycle of circulation.

As the result, it becomes possible to evade an occurrence of problems such as fixing of wrinkles due to "raw folding" or uneveness of gloss due to "Sure in Japanese".

Further, even if the cloth is treated with a low immerging ratio, the front and reverse sides of the cloth could be turned. Therefore, both of the front and reverse sides of the cloth moving in the pool may meet the treating liquid evenly and as the result, levelling, exhausion and a washing effect with a water can be graded up greatly.

By the way, the above mentioned function and advantages may be obtained to a certain extent in the case that the apparatus is used for a cloth which is close in weave.

However, where the apparatus is used for a cloth which is loose in weave, the cloth cannot be moved smoothly in the pool as it is tangled and it is not practically possible to achieve the expected function and advantages. Because, the cloth, which is loose in weave, tends to be involved easily in a turbulent flow of the treating liquid flowing down on the bottom of the pool since the bottom is formed flat, and as the result tangling of the cloth, which is conveyed in the pool of U-letter, occurs frequently.

It is assumed that tangling of the cloth may be occurred in the following steps.

When the cloth and the treating liquid q flow down on the pool, the cloth k tends to close to the outer side of the bottom as is shown with the reference symbol o in FIG. 12, due to a centrifugal force. Although the treating liquid q flowing on the bottom also moves to close to the outside of the bottom, the liquid is intercepted or dammed up by the inside portion of the cloth which is close to the outside, and as the result the liquid q has to be flown through a space p which is positioned inside (See FIG. 13). Therefore, the cloth o close to the outside of the bottom and the liquid q are almost separated.

When the cloth and the liquid are separated, it is difficult that the cloth o closing to the outside flows down due to friction between the cloth and an outer wall portion r (See FIGS. 12 and 13) and also the bottom g (See FIGS. 12 and 13) so as to occur a lump s of the cloth on the outside of the bottom (See FIG. 12). When the lump s is formed on the outside, the following cloth t changes its direction to the inside of the bottom as it is easy to move (See FIG. 12), and as the result the cloth tends to flow down in curving in S-letter while riding on the flowing liquid. The following cloth portion curved and folded tends to move proceeding the outside cloth portion which is hard to move. However, since the outside cloth portion functions as brake, the following cloth portion stops and also forms a lump of cloth u on the inside of the bottom (See FIG. 14).

When a lump of the cloth is thus occurred on the inside of the bottom, the following cloth portion v changes its direction of flow outwardly due to a centrifugal force so as to move smoothly, and then curves in an S-letter so as to approach the outside of the bottom (See FIG. 14). Thereafter, the cloth takes the same movements repeatedly as it flows, and becomes a lump of the cloth in the bottom to form a zigzag.

In addition to this, the cloth moving down with the liquid flowing inside the bottom, tends to be in a floating state, and therefore it sometimes happened that the following cloth portion goes and slips under a floating cloth portion w, as shown in FIG. 15.

With the reasons that the cloth makes a zigzag and slips under the floating cloth portion, the cloth forms tangles y as shown by solid lines in FIG. 11.

SUMMARY OF THE INVENTION

The present invention has an object to provide an improved apparatus for treating a cloth in a flowing liquid which may give a good flowing liquid treatment to the cloth by effectively utilizing an upside-down or inside-out function of the above mentioned conventional apparatus.

In an apparatus for treating a cloth in a flowing liquid comprising a pool having a bottom curved in a shape of U-letter to present a spiral around a vertical axis, said bottom being formed to lower gradually from an upper end to a lower end thereof, a conveying passage continued to the upper end of the pool with its lower end of the conveying passage, a pull-up reel arranged above the pool, wherein a cloth is circulated with the flowing liquid in such a state that the cloth is wound on the pull-up reel endlessly and positioned on the conveying passage and the pool, and said apparatus according to the present invention characterized in that the bottom of the pool is constructed to have a concave surface forming a shape of U-letter in section.

It is preferable to further provide the apparatus with such a construction that the conveying passage is formed to be a cylinder or tube and then the apparatus further comprises ring-like driving nozzle means disposed at an upper portion of an inner periphery of the cylinder to inject a treating liquid downwardly to make a conical shape, and regularizing nozzle means for injecting a treating liquid downwardly along the inner periphery, said regularizing nozzle means being disposed slightly downstream a top of the conical injection by ring-like driving nozzle means to occupy substantially a lower half portion of the cylinder.

According to the present invention, an endless cloth 4 is first wound on a pull-up reel 9 and position on a pool 3 and a conveying passage 5 in such a state that the cloth is twisted once to form a Mobius belt. The cloth 4 is conveyed on the conveying passage 5 together with a flowing liquid in such a state that the cloth is not completely twisted, and then discharged into the pool 3 at a lower end of the conveying passage 5. The discharged cloth 4 moves in the pool 3 and then pulled up by means of the pull-up reel 9 at a lower end of the pool 3, and thereafter conveyed on the conveying passage 5 again.

The cloth 4 is, thus, circulated in the apparatus. A bottom 2 of the pool 3 is curved to present a shape of U-letter around a vertical axis and formed to have a concave surface forming a shape of an alphabetic U in section. Therefore, the cloth 4 moving the curved bottom 2 can be smoothly moved in such a state that the surface of the cloth contacting the pull-up reel 9 faces the bottom 2. With the movement of the cloth, the contacting surface of the cloth with a periphery 13 of the pull-up reel 9 can be turned surely and smoothly upside down or inside out while the cloth performs a circulation in the apparatus.

Such a smooth movement of the cloth 4 in the pool 3 may be obtained by a centering function caused by the bottom 2 which is formed to have a concave surface of U-letter in section. In detail, the centering function in the present invention may be described as follows: Namely, since the bottom 2 is formed to have a concave surface of an alphabetic U in section, as shown in FIG. 3, the treating liquid and the cloth 4 are shifted to a central portion of the bottom due to a gravity. Therefore, even if a centrifugal force acts on the cloth 4, it is hard to separate the cloth 4 from the liquid and then the cloth 4 smoothly moves down riding on the treating liquid.

Where the conveying passage 5 is formed to be a cylinder and ring-like driving nozzle means 15 for conveying the cloth 4 is provided with an upper portion of an inner periphery of the cylinder and further regularizing nozzle means 16 is disposed downstream with respect to said diriving nozzle means 15, the apparatus functions as follows:

A jet stream of conical shape injected from driving nozzle means 15 tends to be a turbulent flow forming a spiral while rotating in a right or left direction due to unevenness of an output pressure of each portion of the ring-like nozzle means 15. Therefore, the cloth 4 may sometimes be twisted while moving on the conveying passage 5 with the flowing liquid from the pull-up reel 9. Particularly, where a plurality of clothes are set in the apparatus, each of the clothes may be tangled one another due to such a turbulent flow and then introduced into the pool 3 with an abnormal tangling state. Further, in the case of a cloth which is loose in weave, it has a tendency to be easily involved in a turbulent flow. In such a tangling state, the cloth 4 cannot be moved smoothly in the pool 3.

Then, regularizing nozzle means 16 injects the treating liquid downstream along the lower half portion in section of the inner periphery of the cylinder, and therefore a direction of the jet stream eliminates an influence of a turbulent flow so as to regularize the cloth 4 in a straight direction and then the cloth 4 can be conveyed downstream to be introduced in the pool 3. Therefore, the cloth 4 cannot be twisted with the above mentioned centering function while moving in the pool 3, as shown in FIG. 9, and even if a plurality of clothes are set, the adjacent clothes would not be tangled one another. When the cloth 4 is pulled up by means of the pull-up reel 9, the cloth 4 is turned inside out or upside down.

Thus, the apparatus may give to a cloth a flowing liquid treatment for such as dyeing, washing, scouring or relaxing the cloth.

As is clear from the above mentioned functions, the present invention has the following advantages.

First, since the apparatus has a pool having a bottom which is curved in a shape of U-letter forming a spiral around a vertical axis and formed to have a concave surface of an alphabetic U in section, it is expected to provide a cetering function for moving the cloth and the treating liquid to a central portion of the bottom in the curved pool by utilizing a gravity when the cloth is set endlessly in the apparatus to form a Mobius belt in order to give a flowing liquid treatment such as for dyeing the cloth. As the result, even if a centrifugal force acts on the cloth, it could not easily separate the cloth from the liquid and the cloth could be conveyed smoothly riding on the liquid, and then the cloth can be surely turned inside out while performing a circulation.

Accordingly, the apparatus of the present invention brings about a superior effect of flowing liquid treatment regardless of the nature of the cloth which is loose or close in weave.

Secondly, where the conveying passage is formed to be a cylinder and ring-like driving nozzle means is provided with an upper portion of an inner periphery of the cylinder and regularizing nozzle means is disposed downstream said ring-like driving nozzle means, said regularizing nozzle means functions to regularize a cloth or clothes to evade a twist or tangle thereof even if the cloth is set in plural so that the cloth or clothes may be smoothly turned inside out continuously.

Other objects and advantages of the present invention will be apparent from the following embodiments with reference to the drawings.

BRIEF DESCRIPTION OF THE DRAWINGS

The drawings show embodiments of an apparatus for treating a cloth in a flowing liquid in which.

DETAILED DESCRIPTION OF THE PREFERRED EMBODIMENTS

First Embodiment

Figure 1:
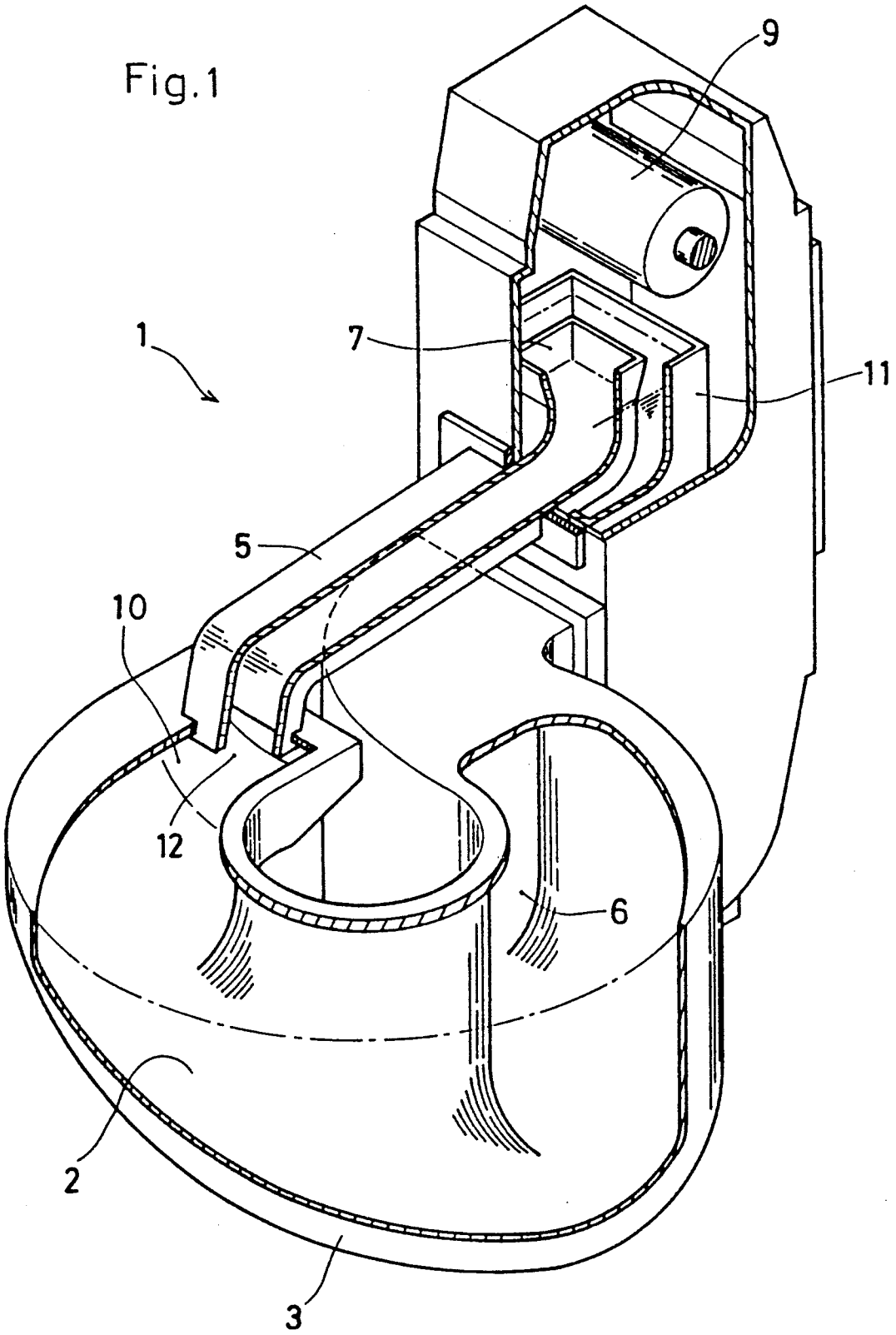
FIG. 1 is a perspective view of the apparatus partly broken away.
Figure 2:
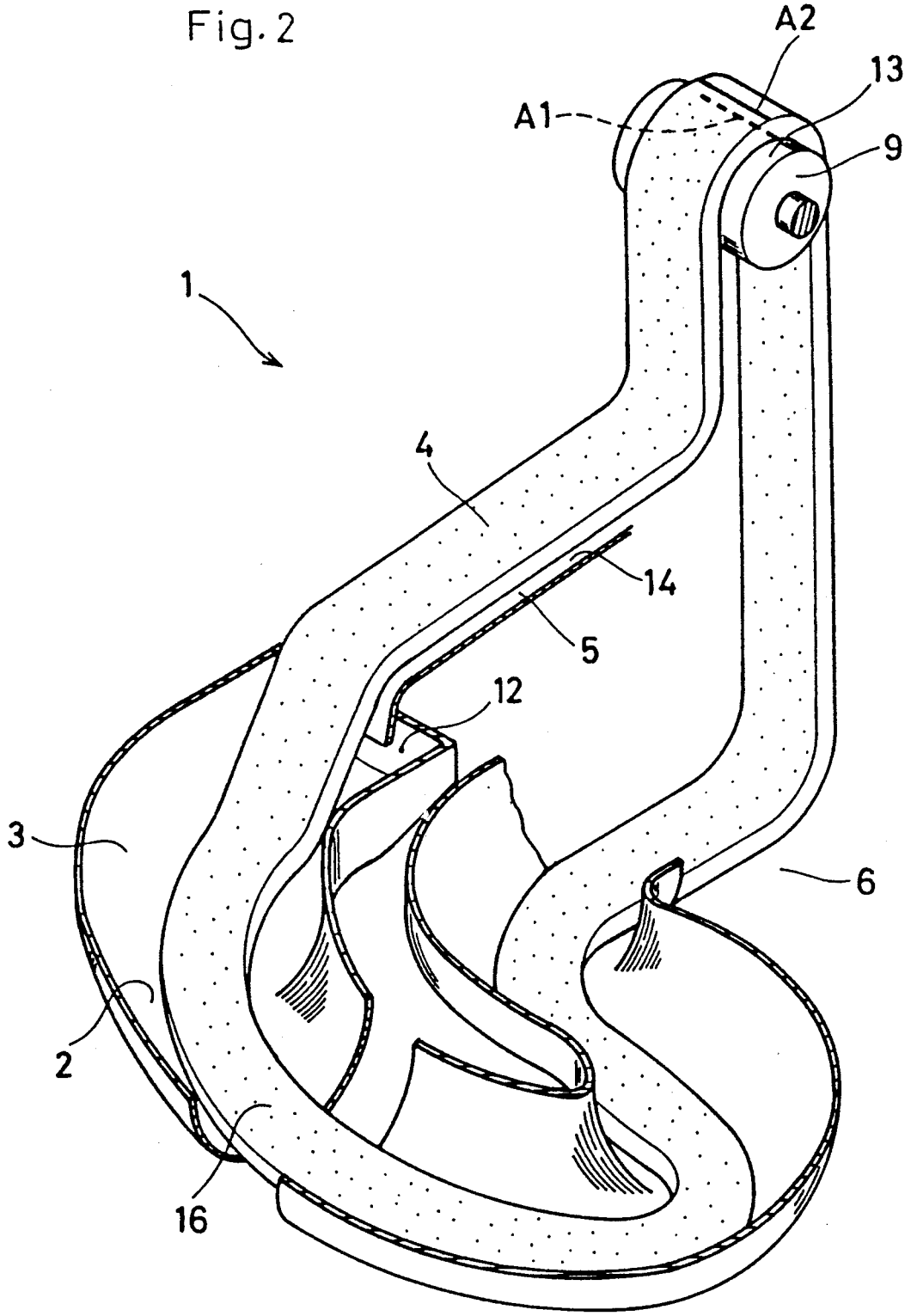
FIG. 2 is a perspective view of the apparatus showing a cloth setting state and a turning operation of the cloth.
Figure 3:
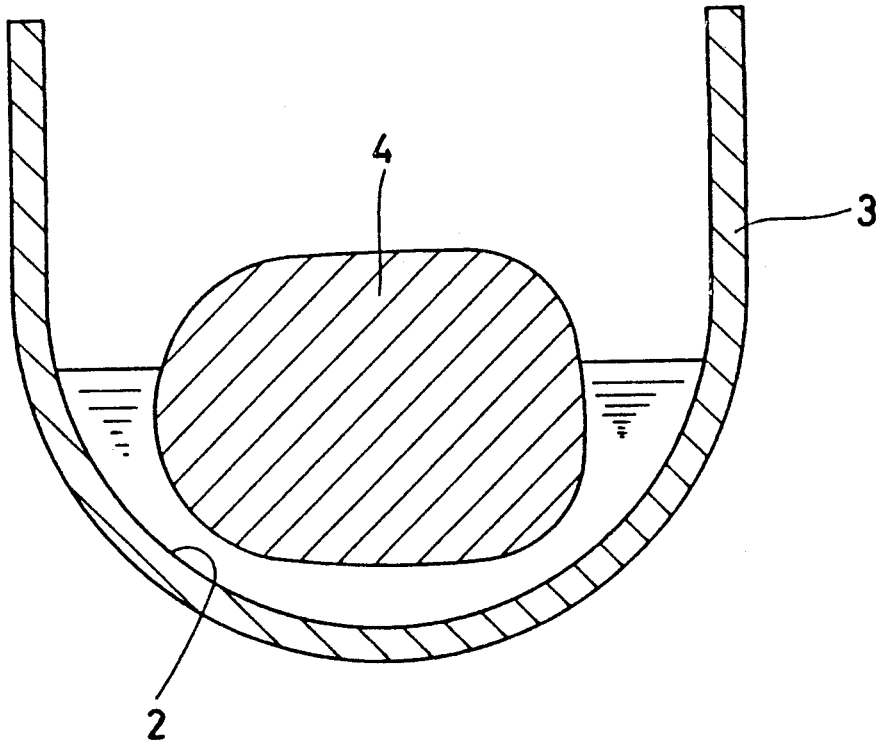
FIG. 3 is a sectional view of a bottom of a pool showing a centering function.

FIGS. 1 and 2 show an apparatus 1 of the present invention which is applied for an apparatus of over-flow type for treating a cloth in a flowing liquid.

The apparatus 1 comprises a pool 3 having a bottom 2 which is curved in a shape of an alphabetic U, a conveying passage 5 disposed above the pool 3 and formed to be a cylinder inclined for conveying a cloth 4, and a pull-up reel 9 arranged between a lower end 6 of the pool 3 and an upper end 7 of the conveying passage 5, wherein the cloth 4 wound on the pull-up reel 9 and set on the conveying passage 5 and the pool 3 may be circulated with a flowing liquid.

The pool 3 has the bottom 2 which is curved in a shape of an alphabetic letter U to present a spiral around a vertical axis and the bottom 2 is formed to be lowered gradually from an upper end 10 to a lower end 6 thereof, and further the bottom 2 is formed to have a concave surface of an alphabetic letter U in section.

The conveying passage 5 is formed to be for example a rectangular or square cylinder and arranged above the pool 3 in an inclined state, so that the cloth 4 may be conveyed with a flowing liquid. The upper end 7 of the conveying passage 5 is discharged upwardly in a storing tank 11 which is disposed above the lower end 6 of the pool 3, and a lower end 12 of the conveying passage 5 is discharged downwardly at the upper end 10 of the pool 3. The storing tank 11 and a drain portion (not shown) of the bottom of the pool 3 are communicated with each other by means of a pipe (not shown), and the treating liquid withdrawn from the drain portion by means of a liquid pump (not shown) is heated by a heat exchanger (not shown) at a predetermined temperature and then supplied to the storing tank 11.

The pull-up reel 9 is disposed above the lower end 6 of the pool 3 and also slightly above the upper end 7 of the conveying passage 5.

When giving a flow liquid treatment to the cloth 4 by using the apparatus, the endless cloth 4, which is twisted once is wound on the pull-up reel 9 and set on the conveying passage 5 and the pool 3. The twist of the cloth may be obtained in such a manner that a surface of an end of the cloth is overlapped on the other surface of the other end of the same cloth so as to form a Mobius band. The endless cloth 4 thus set is contacted with a periphery 13 of the pull-up reel 9, a bottom 14 of the conveying passage 5 and the bottom 2 of the pool 3 without complete twists. After setting the cloth 4, a liquid pump is driven so that the treating liquid sucked from the pool 3 is heated by the heat exchanger at a predetermined temperature and then supplied to the storing tank 11. When the liquid level of the storing tank 11 exceeds an upstream opening edge of the conveying passage 5, the treating liquid in the storing tank 11 overflows into the conveying passage 5. As the result, the cloth 4, which is introduced into the upper end 7 of the conveying passage 5 from the pull-up reel 9, can be conveyed smoothly on the conveying passage 5 together with the flowing liquid. The cloth 4 with the flowing liquid is discharged at the lower end 12 of the conveying passage 5 and thereafter moves in the pool 3. Since the bottom 2 of the pool 3 is curved in a shape of U-letter to present a spiral around a vertical axis and further the bottom 2 is formed to have a concave surface of U-letter in section, the cloth 4 moving the bottom 2 may be moved smoothly in such a state that the surface of the cloth contacting the pull-up reel 9 faces the bottom 2 and that the cloth may be pulled up by means of the pull-up reel 9 at the lower end 6 of the pool 3, as is referred to in the description of function of the apparatus in the summary of this invention.

Where the cloth is pulled up, as shown in FIG. 2, a surface 16 of the cloth 4 moving on the curved bottom 2, which surface is not contacted with the periphery 13 of the pull-up reel 9, automatically becomes a surface which will contact the periphery 13 of the pull-up reel 9 since the cloth is set to form a Mobius band. Suppose that a certain portion of the cloth contacting the periphery 13 of the pull-up reel 9 is a portion A1 of dotted lines, the portion A1 becomes a portion A2 of solid lines which is opposite the portion A1 after the endless cloth 4 performs a circulation. The endless cloth 4 is further circulated once, the portion A2 of solid lines turns to the portion A1 of dotted lines. In other words, the endless cloth 4 may be turned surely and smoothly while moving on the curved bottom 2 naturally. Thereafter, the cloth 4 pulled up is conveyed on the conveying passage 5 in the same manner as described hereinbefore. These operations are repeated so as to level the flowing liquid treatment of the cloth 4.

Second Embodiment

Figure 4:
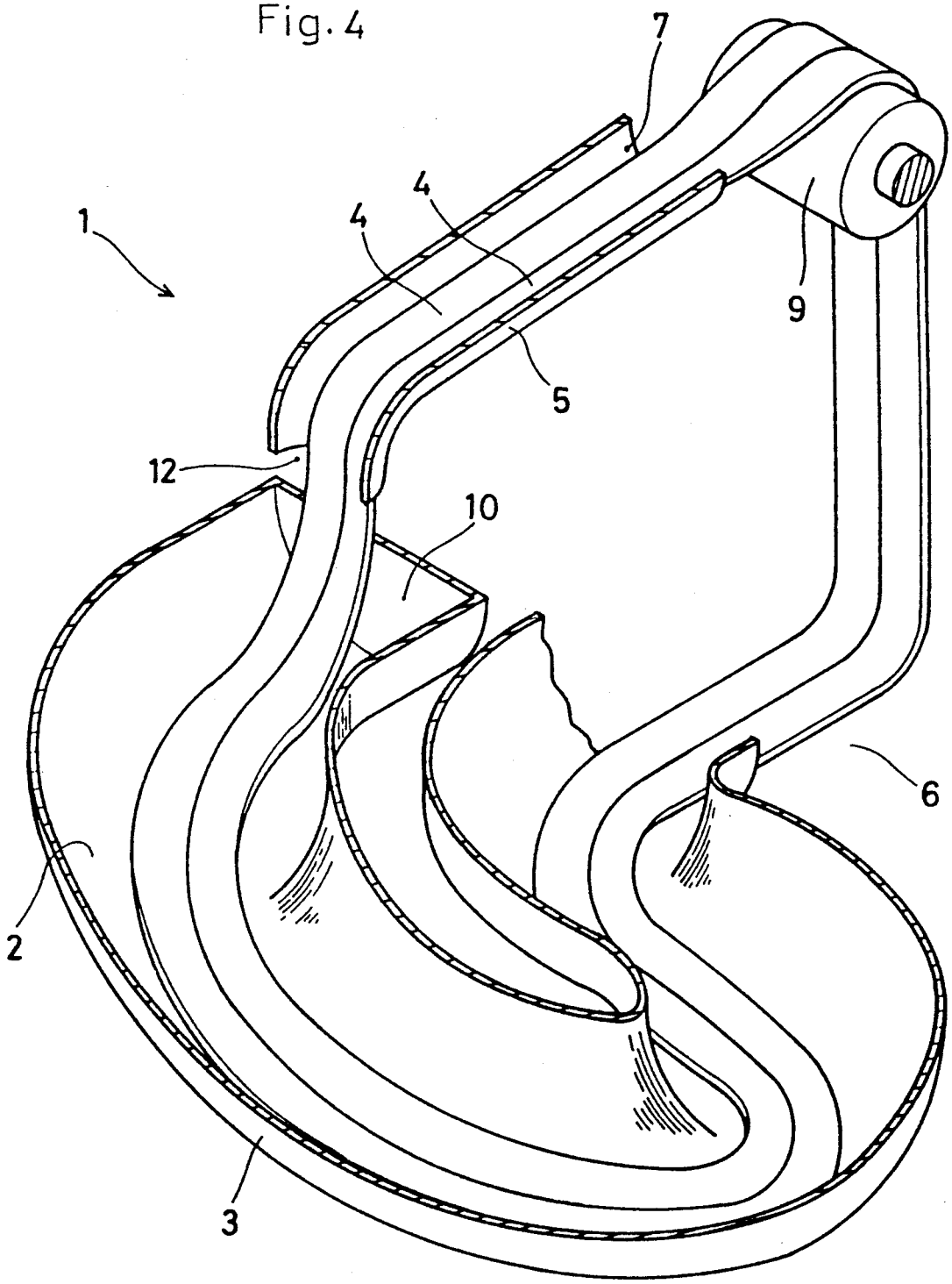
FIG. 4 is a perspective view of the apparatus as another embodiment showing a cloth setting state and a turning operation of the cloth.
Figure 5:
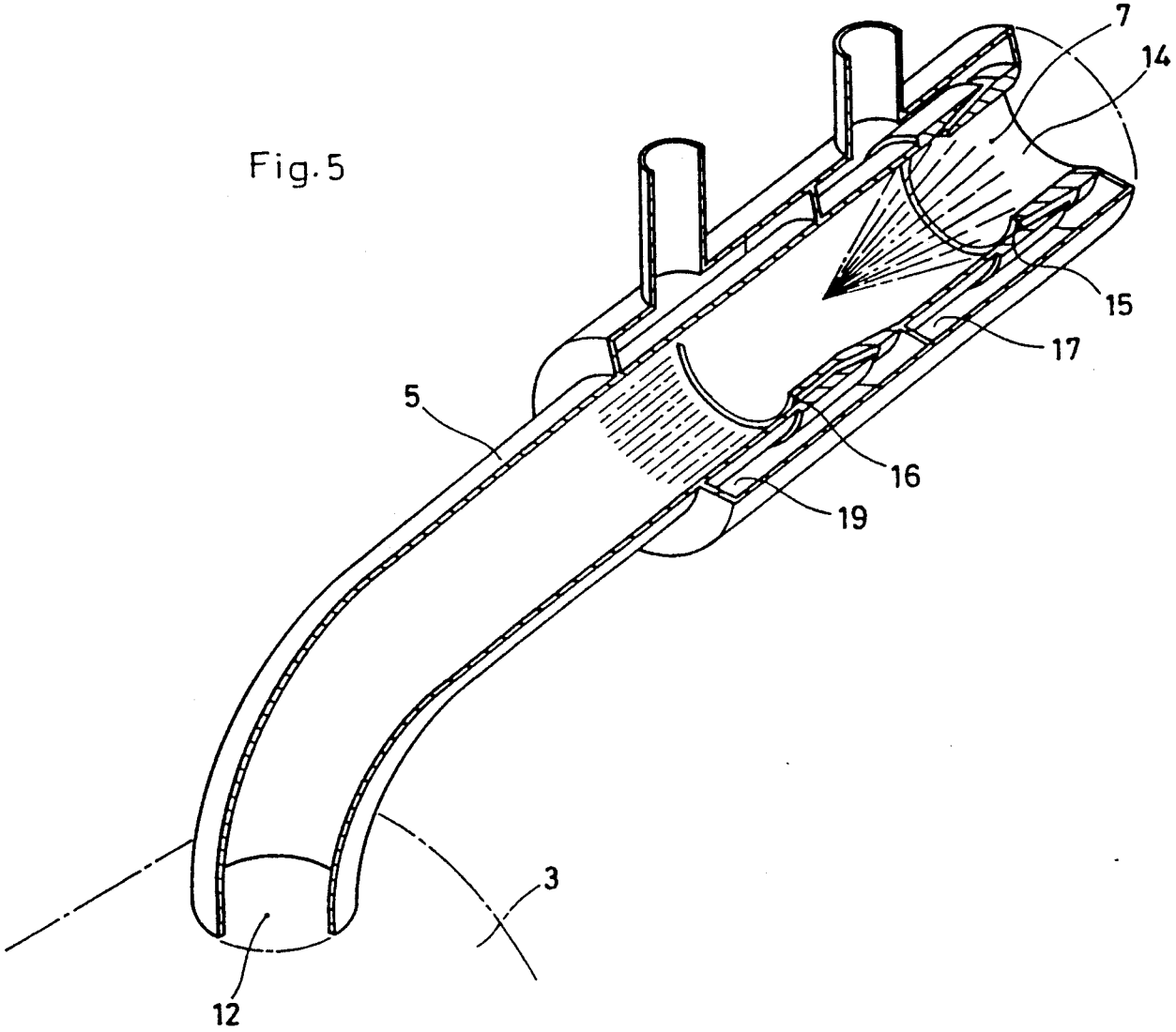
FIG. 5 is a perspective view of the apparatus of FIG. 4 showing a conveying passage.
Figure 6:
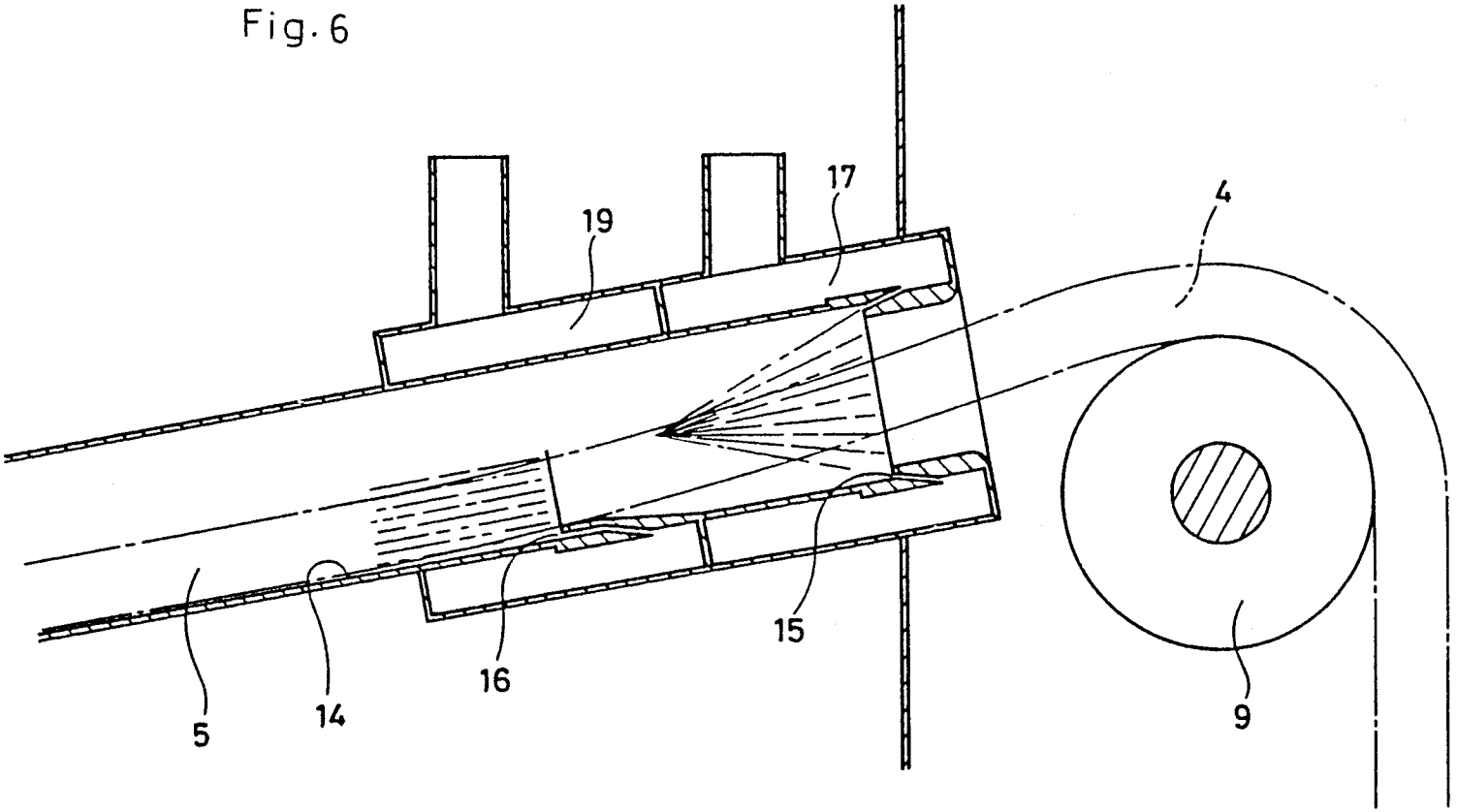
FIG. 6 is a sectional view of the conveying passage of FIG. 4.
Figure 7:
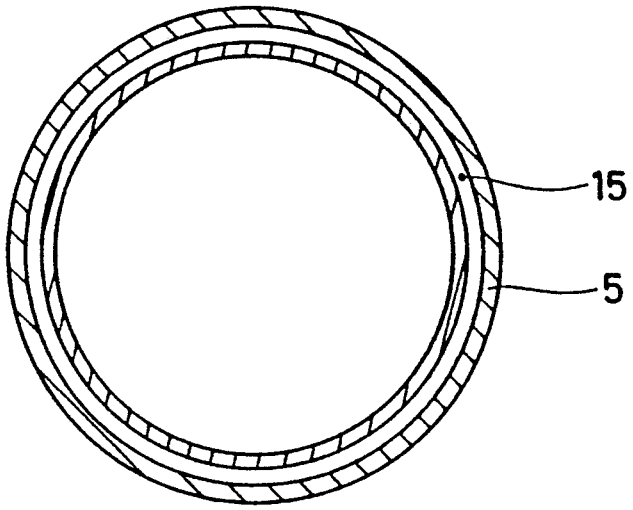
FIG. 7 is a sectional view showing a ring-like driving nozzle.
Figure 8:
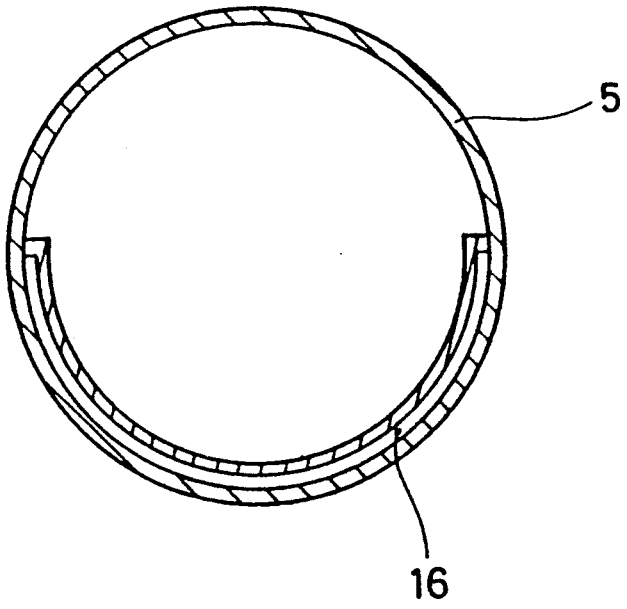
FIG. 8 is a sectional view showing a regularizing nozzle.
Figure 9:
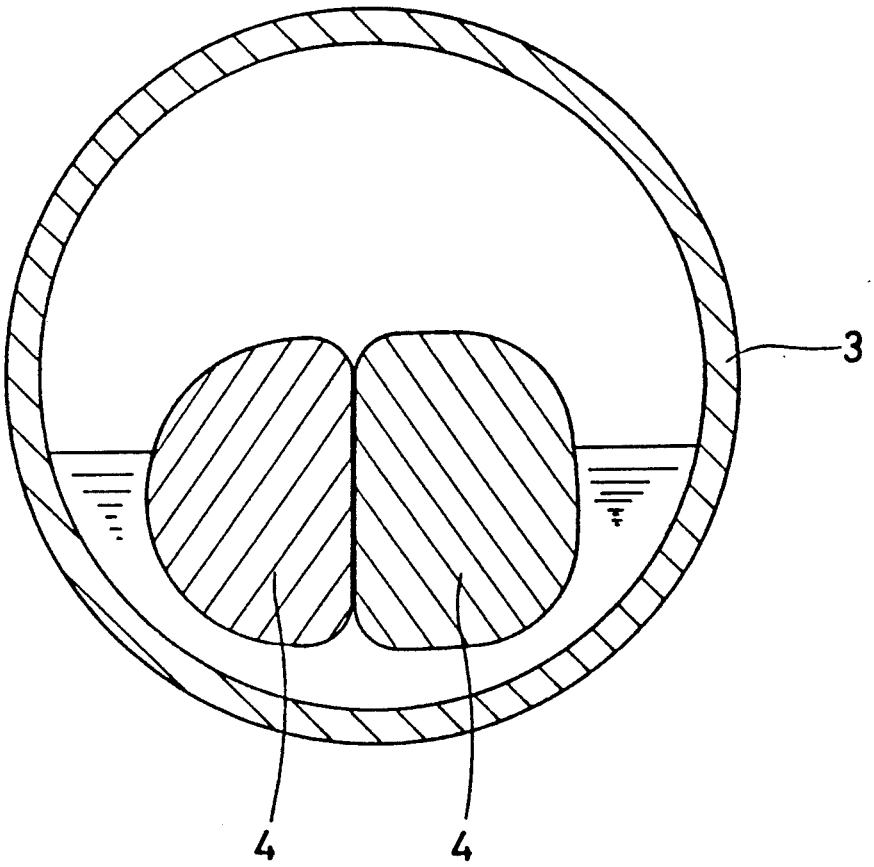
FIG. 9 is a sectional view showing a bottom of a pool showing a centering function.
Figure 10:
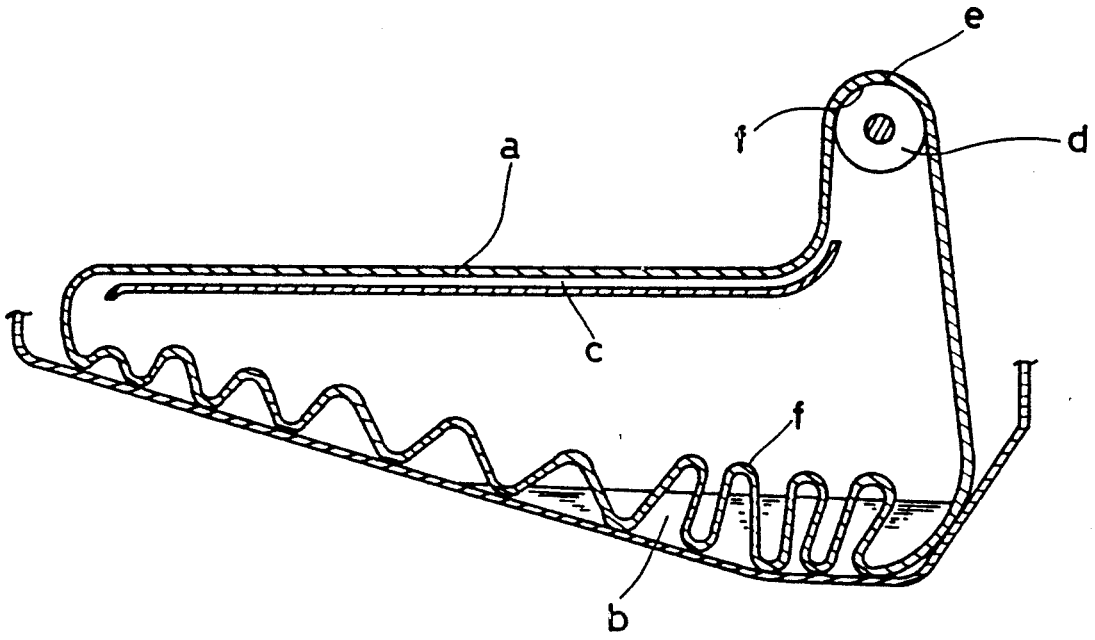
Prior Art Fig.10
FIG. 10 is a sectional view showing a conventional apparatus for treating a cloth in a flowing liquid and also a cloth setting state.
Figure 11:
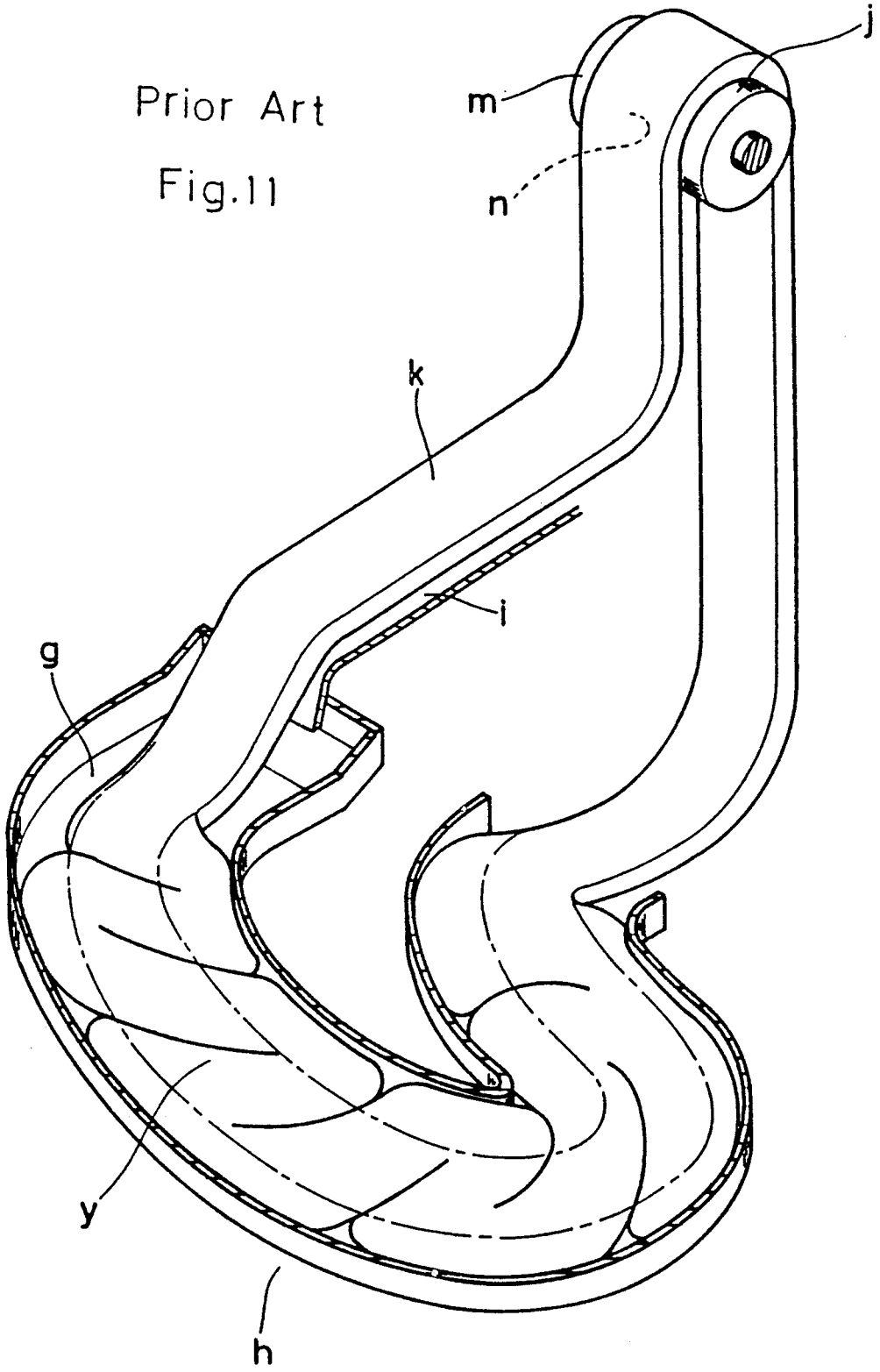
Prior Art Fig.11
FIG. 11 is a perspective view showing an improved conventional apparatus for treating a cloth in a flowing liquid for describing its function and problems.
Figure 12:
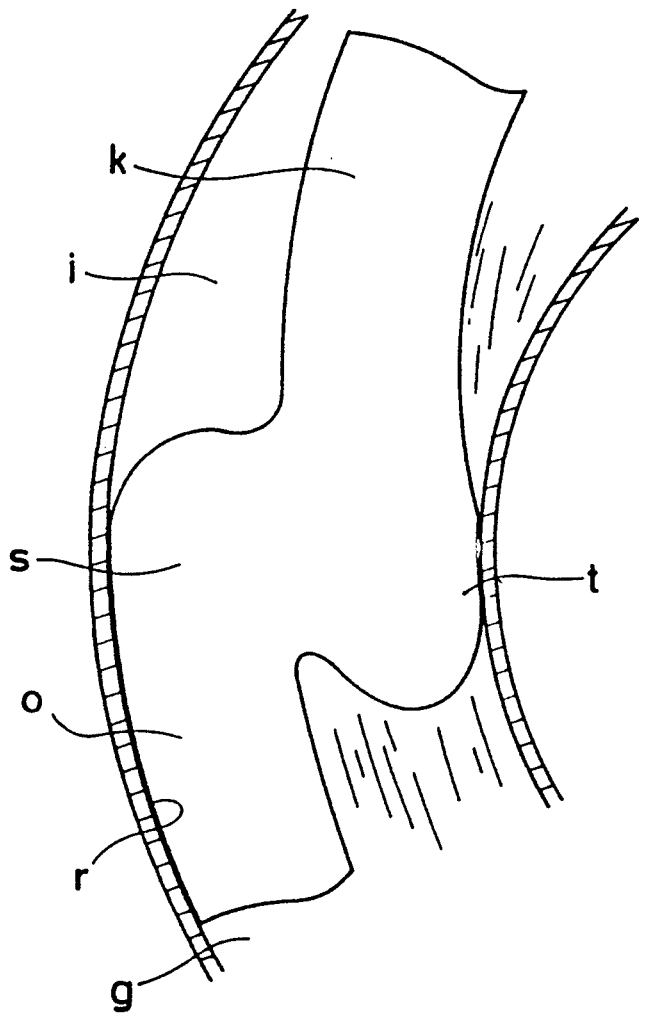
Prior Art Fig.12
FIG. 12 is a plan view showing a step of a cloth tangled.
Figure 13:
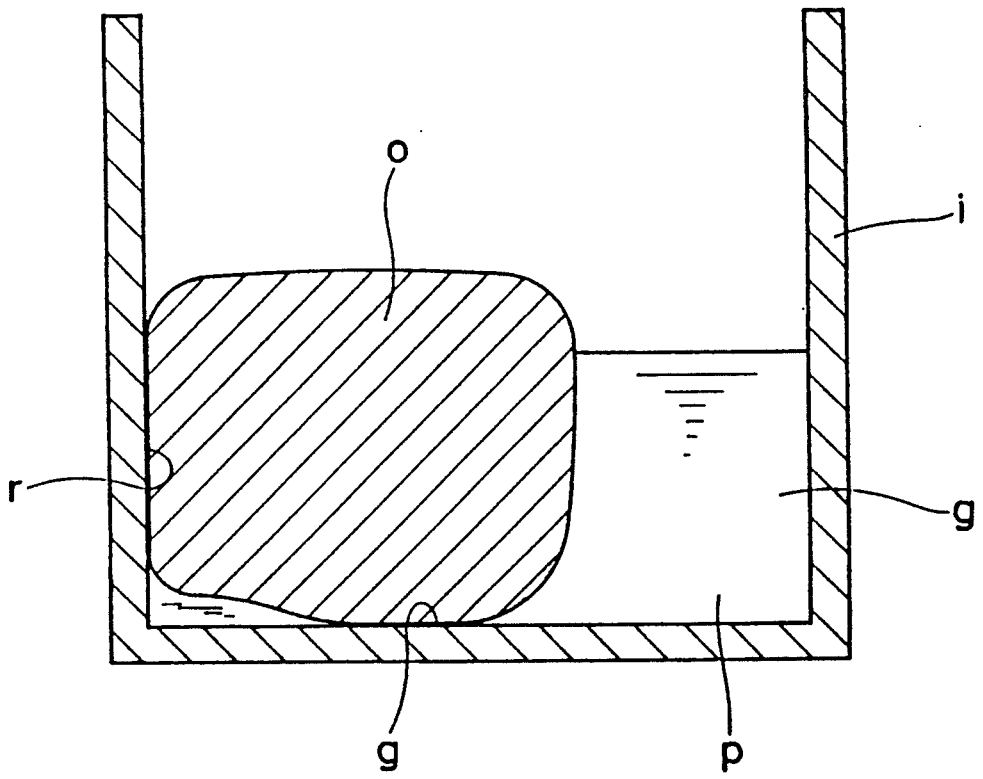
Prior Art Fig.13
FIG. 13 is a sectional view showing another step of a cloth tangled.
Figure 14:
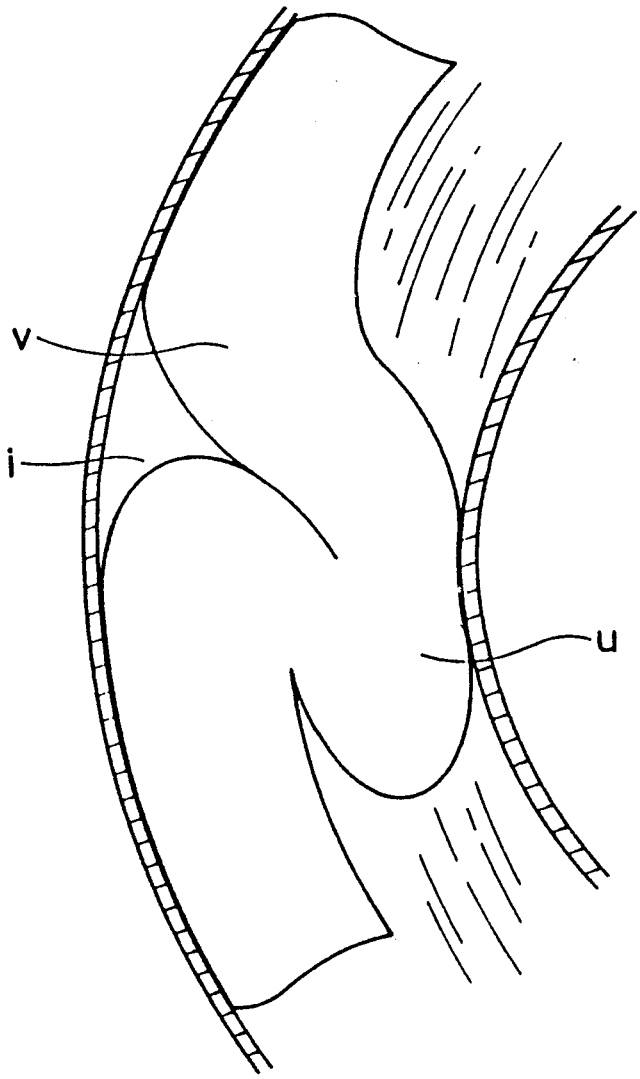
Prior Art Fig.14
FIG. 14 is a plan view showing another step of a cloth tangled.
Figure 15:
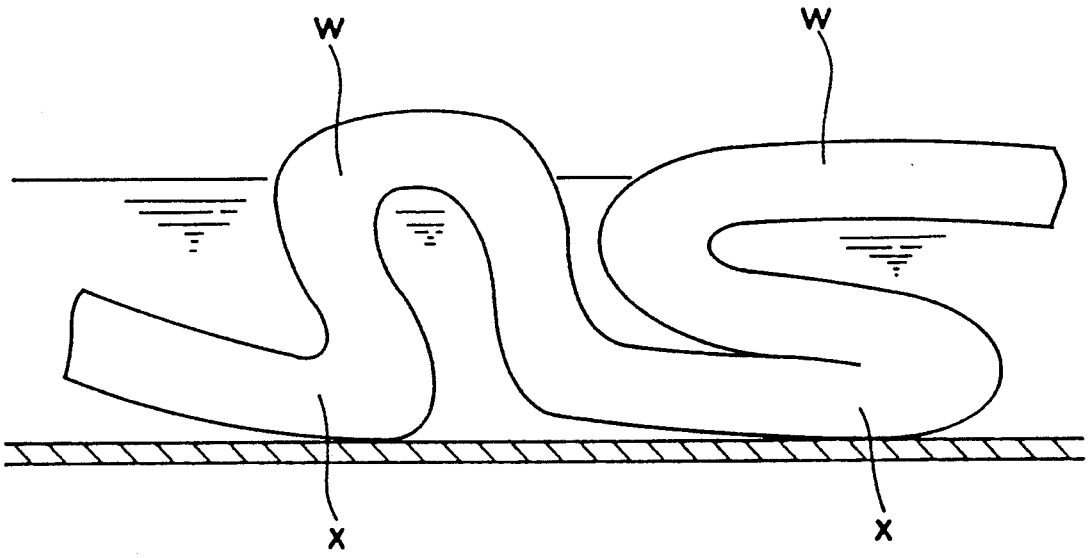
Prior Art Fig.15
FIG. 15 is a vertical sectional view showing another step of a cloth tangled.

FIG. 4 shows the apparatus of this invention which is applied for an apparatus of jet stream type for treating a cloth in a flowing liquid. As described in the first embodiment, the apparatus comprises a pool 3 having a bottom 2 which is curved in a shape of U-letter, a conveying passage 5 disposed above the pool 3 to be inclined for conveying a cloth 4, and a pull-up reel 9 arranged between a lower end 6 of the pool 3 and an upper end 7 of the conveying passage 5, wherein the cloth 4 wound on the pull-up reel 9 and set on the conveying passage 5 and the pool 3 may be circulated with a flowing liquid.

As shown in FIG. 4, the pool 3 has the bottom 2 which is curved in a shape of an alphabetic letter U to present a spiral around a vertical axis and the bottom 2 is formed to be lowered gradually from an upper end 10 to a lower end 6 thereof, and further the bottom 2 is formed to have a concave surface of U-letter in section.

As shown in FIGS. 4 through 8, the conveying passage 5 is formed to be a cylinder and the upper end 7 of the conveying passage 5 is opened inclinedly and upwardly above the lower end 6 of the pool 3, and then a lower end 12 of the conveying passage 5 is discharged downwardly at the upper end 10 of the pool 3. A ring-like driving nozzle 15 is disposed at an upper portion of an inner periphery 14 of the cylinder to inject a treating liquid downwardly to make a conical shape, and a regularizing nozzle for injecting a treating liquid downwardly along the inner periphery 14, is disposed slightly downstream a top of the conical injection by the ring-like driving nozzle 15 to occupy substantailly a lower half portion of the cylinder. In FIG. 4, the driving nozzle and the regularizing nozzle are omitted.

Further, each of storing chambers 17 and 19 of the driving nozzle 15 and the regularizing nozzle 16 is communicated with each of drains (not shown) of the bottom of the pool 3 by means of a pipe (not shown), and the treating liquid sucked from the drains by means of a liquid pump (not shown), is heated by a heat exchanger (not shown) at a predetermined temperature and then supplied to each of the storing chambers.

Furthermore, the pull-up reel 9 is disposed above the lower end 6 of the pool 3 and also slightly above the upper end 7 of the conveying passage 5.

When giving a flow liquid treatment to the cloth 4 by using the apparatus of this embodiment, as shown in FIG. 4, two endless clothes 4, each of which is twisted once to form a Mobius band, are wound on the pull-up reel 9 and set on the conveying passage 5 and the pool 3, in two rows. After setting the clothes 4, the liquid pump is driven so that the treating liquid sucked from the pool 3 is heated by the heat exchanger at a predetermined temperature and supplied to each of the liquid chambers 17 and 19 and then the liquid is injected by means of the driving nozzle 15 and the regularizing nozzle 16. A conical jet stream injected from the driving nozzle 15 (see FIGS. 5 and 5) tends to be a turbulent flow forming a spiral due to such as unevenness of an output pressure of each of the ring-like nozzle portions of the driving nozzle. The clothes 4 may sometimes be involved in the turbulent flow and then twisted or tangled with one another while moving on the conveying passage 5, but a directional jet stream injected from the regularizing nozzle 16 may eliminate an influence of such a turbulent flow so as to regularize the clothes straight and move same downstream. The strength of jet stream may be adjusted by operating a valve, considering such as the nature of the colthes which are loose or close in weave, so as to regularize the clothes and move same smoothly.

As the result, the clothes 4 can be introduced in the pool 3 in such a state that they are properly separated in two rows. The reverese surfaces of the clothes 4 contacting the pull-up reel 9 move smoothly on the bottom 2 while facing the bottom 2 and at the lower end of the pool 3, the clothes are turned inside out and then pulled up by means of the pull-up reel 9.

What is claimed is:

1. In an apparatus for treating a cloth in a flowing liquid comprising a pool having a bottom portion curved in a cross sectional shape of an alphabetic letter U to present a downwardly extending spiral around a vertical axis, said bottom being formed to lower gradually along the spiral from an upper end to a lower end thereof, a conveying passage continues from the upper end of the pool to a lower end of the conveying passage, a pull-up reel arranged above the pool, wherein a cloth is circulated with the flowing liquid in such a state that the cloth is wound on the pull-up reel endlessly and directed along the conveying passage and through the pool, said apparatus characterized in that:

the bottom portion of the pool is constructed to have a concave surface forming a shape of said alphabetic letter U in section.

2. The apparatus as claimed in claim 1 wherein the conveying passage is formed to be a cylinder, said apparatus further comprising:

a ring-like driving nozzle means disposed at an upper portion of an inner periphery of the cylinder to inject a treating liquid downwardly to form a conical shape, and regularizing nozzle means for injecting a treating liquid downwardly along the inner periphery, said regularizing nozzle means being disposed slightly downstream of an upper end of the conical shaped injection by ring-like driving nozzle means to occupy substantially a lower half portion of the cylinder.

* * * * *